US009581005B2

(12) United States Patent
Noe et al.

(10) Patent No.: US 9,581,005 B2
(45) Date of Patent: Feb. 28, 2017

(54) METHOD TO UNDERDISPLACE HYDRAULIC FRACTURES IN HORIZONTAL OR DEVIATED WELL

(71) Applicant: Shell Oil Company, Houston, TX (US)

(72) Inventors: Jeffrey Maloy Noe, Houston, TX (US); David Paul Brisco, Duncan, OK (US); Benjamin Mowad, Houston, TX (US); Robert Dale Smith, Bowie, TX (US); Ernesto Rafael Fonseca Ocampos, Houston, TX (US); Joddie Joseph Carlile, Chappell Hill, TX (US)

(73) Assignee: SHELL OIL COMPANY, Houston, TX (US)

( * ) Notice: Subject to any disclaimer, the term of this patent is extended or adjusted under 35 U.S.C. 154(b) by 193 days.

(21) Appl. No.: 14/480,819

(22) Filed: Sep. 9, 2014

(65) Prior Publication Data

US 2015/0129212 A1 May 14, 2015

Related U.S. Application Data

(60) Provisional application No. 61/876,296, filed on Sep. 11, 2013.

(51) Int. Cl.
*E21B 33/08* (2006.01)
*E21B 43/267* (2006.01)

(52) U.S. Cl.
CPC ..... *E21B 43/267* (2013.01)

(58) Field of Classification Search
CPC ..... E21B 33/08; E21B 34/063; E21B 43/267
See application file for complete search history.

(56) References Cited

U.S. PATENT DOCUMENTS 3,654,992 A 4/1972 Harnsberger et al.
4,531,583 A * 7/1985 Revett ..... E21B 29/00 166/277
6,527,057 B2 * 3/2003 Fraser, III ..... E21B 33/16 166/156
8,276,677 B2 * 10/2012 Ravensbergen ..... E21B 17/20 166/120

* cited by examiner

*Primary Examiner* — Catherine Loikith

(57) ABSTRACT

A method for underdisplacing fracture proppant in a well bore. The method can include providing a set retainer having a passage configured to receive a wiper plug. The method may also include installing the set retainer in the well bore and injecting a proppant-laden fluid into the well bore, through the passage of the set retainer and through a perforation to create the fracture. The method may include providing a wiper plug configured to be received in the passage of the set retainer. The method may also include inserting the wiper plug into the well bore and allowing the wiper plug to wipe a portion of the proppant-laden fluid past the set retainer and into the fracture. Additionally, the method may include allowing the set retainer to receive the wiper plug.

19 Claims, 7 Drawing Sheets

METHOD TO UNDERDISPLACE HYDRAULIC FRACTURES IN HORIZONTAL OR DEVIATED WELL

RELATED CASES

This application claims the benefit of U.S. Provisional Application No. 61/876,296, filed on Sep. 11, 2013, which is incorporated herein by reference.

FIELD OF THE INVENTION

The present disclosure relates to methods and equipment for improving the efficiency of hydraulic fracturing operations. More specifically, the disclosure relates to optimizing proppant concentration at the interface between well bore and subsurface fractures.

BACKGROUND OF THE INVENTION

Oil and natural gas are crucial commodities in the world's supply of energy resources. As such, the excavation of these commodities from beneath the surface of the earth is an important activity in the energy industry. Several companies dedicate immense time and effort to the efficient extraction of oil and natural gas from the subsurface.

To obtain hydrocarbons from beneath the earth's surface, energy producers use complex operations and a variety of technologies to obtain the hydrocarbons from different sources. Hydrocarbons may be found, for example, in oil rich sands and deposits located in geological formations beneath the earth. A recently profitable technique for extracting these resources is known by those in the art as "hydraulic fracturing" and is also known in the industry as "fraccing." This method generally includes drilling a subsurface well bore, providing perforations in the well bore, and injecting a fracture fluid into the perforated hole. The fracture fluid is pumped into the well bore at elevated pressure, thereby causing fissures or fractures to open beneath the surface. Resources such as oil and natural gas flow from the fractures into the well bore, where they can be relayed to the surface. An example method of hydraulic fracturing is disclosed in U.S. Pat. No. 3,654,992 to Harnsberger et al.

In many situations, the fracture formation process can be improved by incorporating a material known as "proppant." Proppant refers to any of a variety of materials that can be mixed with the fracturing fluid. Proppant is so named because it is made up of particles which "prop open" a fracture formed by hydraulic fracturing fluid for as much time as is needed for the new fracture to deplete the reservoir. Suitable proppant materials can include sands, glass, mortar, or other particulate solids that can easily remain inside the opened fracture. Proppant may be helpful because it tends to maintain stability in the opened fracture, thereby allowing extraction of hydrocarbons or other fluids.

In practical applications, proppant can work more effectively when it is concentrated at the spatial interface between the well bore and the newly created fracture. If proppant is highly concentrated in this area, the fracture may cover a larger spatial volume and remain stable more easily. This interface area, where proppant tends to be most effective, is sometimes called the "critical zone."

SUMMARY OF THE INVENTION

In accordance with preferred embodiments of the present disclosure there is provided a method for underdisplacing fracture proppant in a well bore. The method can include providing a set retainer having a passage configured to receive a wiper plug. The method may also include installing the set retainer in the well bore and injecting a proppant-laden fluid into the well bore, through the passage of the set retainer and through a perforation to create the fracture. The method may include providing a wiper plug configured to be received in the passage of the set retainer. The method may also include inserting the wiper plug into the well bore and allowing the wiper plug to wipe a portion of the proppant-laden fluid past the set retainer and into the fracture. Additionally, the method may include allowing the set retainer to receive the wiper plug.

There is also an apparatus disclosed. The apparatus may include a body with a passage extending from a first end to a second end and configured to retain a stopper. The apparatus may also include a plurality of wipers disposed on the body and a rupture disc configured to block fluid flow through the passage, and to rupture at a user-defined pressure. The apparatus may include a slip retainer disposed on the body and configured to be retained by a set retainer having a latch.

As used in this specification and claims the following terms shall have the following meanings:

Any reference to the term "uphole" means a segment of well bore located along the well bore between a recited location of well bore and the point at which the well bore meets the surface of the earth. Although the term "uphole" can imply reference to locations closer to the surface than the recited point or location, those skilled in the art will appreciate that it can refer to locations further away from the earth's surface if the well bore includes U-shaped portions, which for example may return to a higher elevation.

Any reference to the term "downhole" means a segment of well bore located along the well bore further into or further along the well bore completion than the recited point or location. Although the term "downhole" can imply reference to locations further below the surface than the recited point or location, those skilled in the art will appreciate that it can refer to locations closer to the surface if the well bore includes U-shaped or similar segments, where for example the well bore may run closer to the surface after having traversed well bore sections further below the ground.

The term "mechanically coupled" does not necessarily mean direct mechanical coupling; the coupling can be indirect with other structure interposed between two components that are nonetheless mechanically in communication or coupled to each other.

The term "conductivity" generally refers to the ease by which hydrocarbons, oil, natural gas, or other energy resources located in a subsurface formation can migrate from the formation into the well bore (e.g., by travelling through the fracture).

The foregoing has broadly outlined some of the aspects and features of the present disclosure, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope of the invention defined by the claims.

BRIEF DESCRIPTION OF THE DRAWINGS

For a more detailed understanding of the present disclosure, reference is made to the accompanying wherein.

DETAILED DESCRIPTION OF A PREFERRED EMBODIMENT

Figure 1:
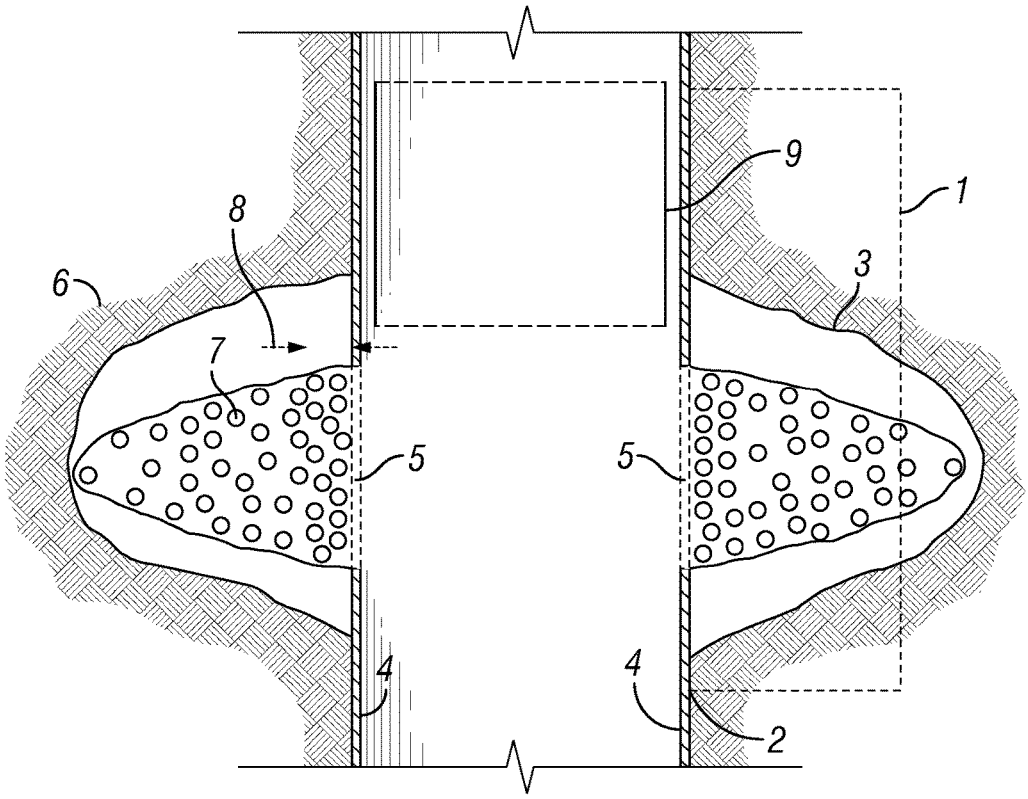
FIG. 1 is a schematic illustration of a vertical section of a well bore within which one embodiment of the disclosed apparatus and method can be used.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

The present disclosure relates to an apparatus and method for improving the concentration of proppant in the critical zone of a subsurface fracture in a hydraulic fracturing process. The apparatus and method can be deployed in any hydraulic fracturing well bore, whether it contains vertical or deviated sections, with only minor modifications. The disclosed techniques may improve the concentration of proppant material used to hold a hydraulic fracture open, at the "critical zone," or interface between the fracture and a well bore. Therefore, persons engaged in a hydraulic fracturing operation may be able to intentionally underdisplace proppant inside a well bore. If this is done, some proppant can migrate into the critical zone when this method and its corresponding apparatuses are used. Additionally, the simultaneous benefits of a high proppant concentration at the well bore interface and a lower amount or elimination of proppant inside the well bore above the set retainer can be achieved. The underdisplacement of proppant inside the well bore often leads to costly mechanical issues and a greater number of trips to clean a well bore required to continue to run smooth fracture divergence fractures like plug and perforating. The disclosed techniques may avoid this problem by providing an effective method for removing proppant from the well bore so that hydraulic fracturing operations can be conducted elsewhere within the well bore.

Optimally, enough proppant would be provided to maintain a high concentration of proppant in the critical zone and hold the fracture open. If a high concentration of proppant is successfully added to the critical zone, conductivity near the well bore may be optimized, thereby increasing the flow rate of extracted substances from the fracture into the well bore.

Although proppant is often helpful in a hydraulic fracturing operation, it can lead to difficult complications. One problem associated with the use of proppant is known as the "pinching off" effect. This issue often arises when the proppant-laden fracture fluid creates and enters a new fracture. Proppant already inside the fracture can be "flushed" further into the fracture by the rest of the fluid, decreasing the concentration of proppant within the critical zone and consequently leaving the fracture face entirely or partially unpropped. This pinching effect is due to rock stresses overcoming fracture pressure in an unpropped fracture area. When this occurs, much of the proppant may be concentrated at the periphery of the perforations, resulting in less proppant at the interface between the fracture and the well bore than would otherwise be desired.

One solution to this problem is to develop and use advanced models of proppant behavior in the well bore to predict a desired amount of fluid and proppant for making a fracture. Such models are generally effective at ensuring a higher concentration of proppant in the critical zone and improving conductivity. However, making these models can be difficult, costly, and require the assistance of experienced technical personnel. When more time and effort is spent to develop an advanced model, technical experts may not have adequate time to attend to other projects. Additionally, hydraulic fracturing occurs at a variety of sites with markedly different well designs and geological concentrations. These differences may require new models at each site or group of sites.

An alternative proposed solution to this problem has been to "underdisplace" the proppant when injecting it into the well bore. "Underdisplacement" is the act of displacing proppant inside the well bore at a given concentration, so that it can be flushed outside the well bore and into the critical zone. When fracture fluid creates a fracture and eventually seeps into the geological formation, some of the underdisplaced proppant may enter the fracture along with it.

Underdisplacement of proppant often causes other issues to arise, however. One such issue is that the underdisplaced proppant can become lodged in the well bore before it gets close to the fracture. If too much proppant accumulates in the well bore, costly problems often result. For example, leftover proppant can agglomerate inside the well bore, thereby causing segments of the well bore to become obstructed for subsequent fracture divergence operations. If subsurface components and instruments are subsequently run on a wireline, the agglomerated proppant can obstruct the wireline, thereby impeding users from removing equipment from the well bore. If proppant obstructs the well bore, it generally must be cleaned out. These cleaning operations are costly, can damage the productivity of the fractures because of fluid losses and lessen the fracturing site's profitability.

The risk of these difficult complications increases when the hydraulic fracturing operation uses a deviated well bore. In the context of this application and as further explained below, a deviated well bore refers to any subsurface well bore where at least part of the well bore runs in a direction not perpendicular to the surface. A deviated well bore does not need to be entirely horizontal, but in many cases could have one or more horizontal or partially horizontal segment. Deviated well bores pose a technical challenge because gravity does not necessarily provide enough force to move equipment further "downhole." Rather, fluid or some other motive force is necessary to install hydraulic fracturing equipment in a deviated well bore, particularly a horizontal wellbore. Since an increasing number of hydraulic fracturing operations are conducted in deviated well bores, this technical challenge is significant, particularly in toe up wells designed for better water handling.

These obstacles to cost-effective hydraulic fracturing pose significant risks to resource production and profitability. As a result, the accessibility of resources obtained by hydraulic fracturing would be greatly increased if a technical apparatus and method could avoid these issues or other problems, particularly in a deviated well bore.

One significant advantage that may be provided by the disclosed apparatus and methods are that the conductivity of the well bore may be increased by increasing the concentration of proppant in the critical zone. A further potential advantage is that components of the well bore uphole of the subsurface fracture can be cleaned and prepared for further fracturing operations.

Referring to FIG. 1, a diagram of a vertical well bore is provided. The figure depicts a vertical section 1 of a well bore 2, within which one embodiment of the disclosed apparatus and method can be used. A well bore 2 extends below the surface of the earth into a formation 3 containing material rich in oil or other energy resources. If the well bore 2 is cased, the casing 4 may be punctured via explosion, use of a perforation gun, or other method to create perforations 5 or communication to the reservoir (e.g., sliding sleeves in cemented or open holes) allowing fluid communication between the interior of the casing 4 and the formation 3. Whether perforating is conducted or not, hydraulic fracture fluid (not shown) is introduced into the well bore 2 to gradually create a fracture 6 as it flows through the perforations 5.

To hold the fracture 6 open, proppant 7 may be introduced into the fracture. Proppant may help to create and maintain a fracture sized for optimal production of hydrocarbons when a high concentration of the proppant material is in the fracture's critical zone. This critical zone is designated by line 8 at the interface between the well bore 2 and the fracture 6. In accordance with one embodiment, proppant 7 is introduced to the well bore 2 and flushed into the fracture 6 when fracturing fluid is used to form the fracture. In some embodiments, vertical section 1 is downhole of another zone, downhole of a portion of the same zone, or otherwise spatially separated from an uphole section 9.

Figure 2:
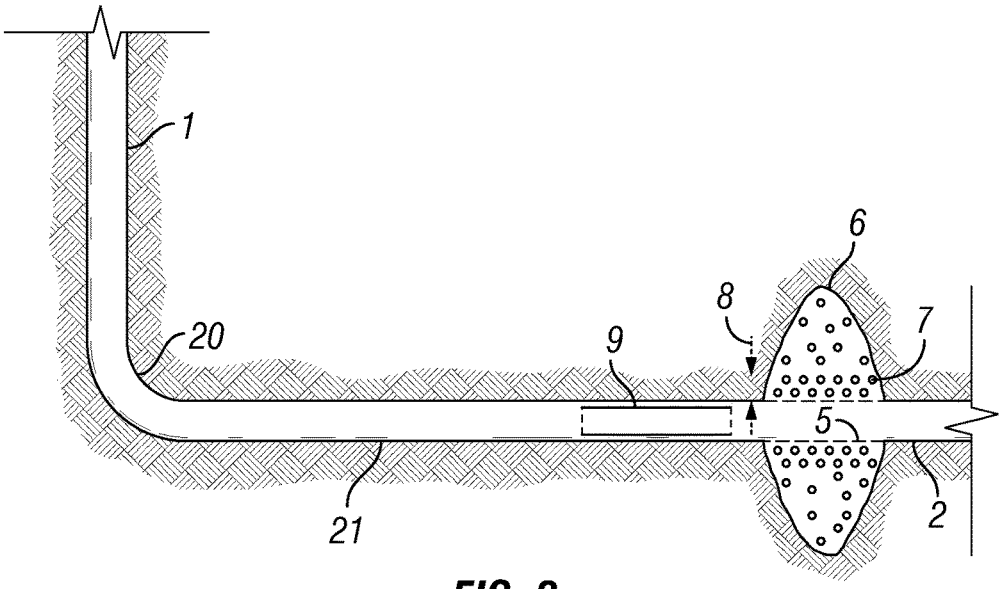
FIG. 2 is a schematic illustration of a horizontal section of well bore within which an embodiment of the disclosed apparatus and method can be used.

Turning to FIG. 2, a similar diagram is provided to depict a horizontal well bore for hydraulic fracturing. In this example, a vertical section 1 of the well bore 2 transitions by an elbow section 20 into a horizontal section 21. While a horizontal section 21 is represented for simplicity, the disclosure can likewise be used in any of a number of other other deviated trajectories (e.g., snake shapes, toe up, or toe down). In such embodiments, reference to the horizontal section 21 may simply be replaced with the appropriate deviated section without significant modification to the design. As with the well bore 2 described previously, the horizontal section 21 may be cased and include perforations 5, allowing a fracture 6 to be created by injecting a hydraulic fracturing fluid (not shown). Proppant 7 may be dispersed inside the fracture 6, and conductivity may be increased when the proppant 7 is highly concentrated in the critical zone 8. The critical zone 8 is generally located at the interface between the horizontal section 21 and the subsurface fracture 6. An uphole section 9 of the well bore 2 may be addressed as further described in certain embodiments.

In a horizontal section 21, the force of gravity alone cannot be used to install equipment in the uphole section 9. As a result, an installation fluid, a fracture treatment fluid, or some combination of those fluids can be used to pump equipment into the horizontal section 21 of the well bore 2. The equipment, when installed, is also preferably tethered to the surface or run on a wireline (not shown). This allows the equipment to be extracted by pulling it out of the well, so that it can be reused, for instance in other drilling or fracturing operations.

Figure 3:
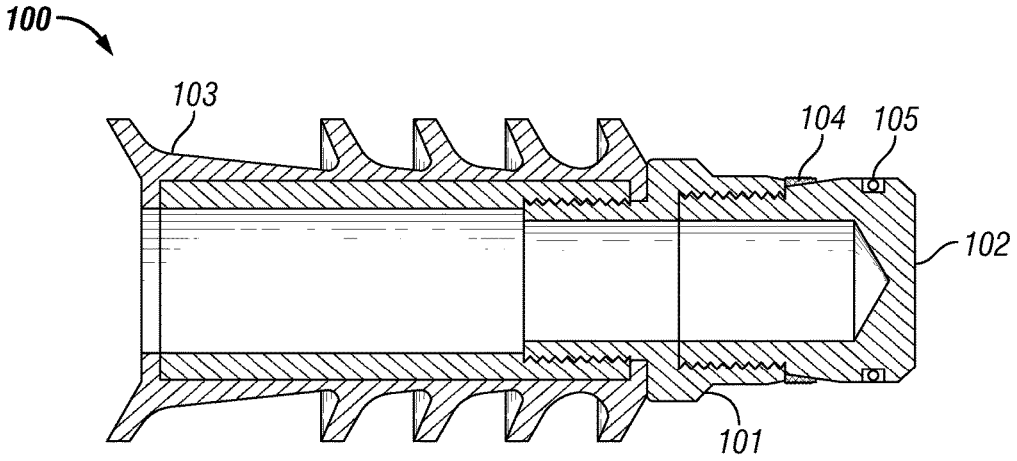
FIG. 3 depicts a wiper plug apparatus for use in a vertical well bore.

One apparatus 100 capable of performing some of the methods described herein is depicted in FIG. 3. Although the apparatus 100 depicted has a horizontal orientation, the apparatus 100 may be used in a vertical well bore. The apparatus 100 may be capable of wiping away any proppant in its path of travel through the well bore 2. The apparatus 100 is also designed as a substantially cylindrical wiper plug 101, similar to those used in subsurface cementing operations. The wiper plug 101 may include a body 102, which may also be substantially cylindrical in shape. Several wipers 103 may be disposed on the body 102 of the wiper plug 101, and dimensioned to fit within the area of a well bore (e.g., within the casing or within an openhole section). The appropriate dimensions will vary from wiper to wiper, and will can be dimensioned to the area of a corresponding well bore such that the wipers 103 remove any remaining proppant from the inside of the well bore as the wiper plug 101 travels from the surface to the site of a hydraulic fracture. The wipers 103 can be made from rubber or a similar flexible material to aid the wiping ability of the wiper plug 101. The wiper plug 101 can also include one or more retaining slips 104 located on its body 102, which can be retained by a set retainer 300 (illustrated in FIG. 5). The retaining slips 104 may allow the wiper plug 101 to stop traveling through the well bore 2 when it reaches the set retainer 300 (described in detail with respect to FIG. 5). One or more seals 105 can also be located on the wiper plug 101 to further connect the wiper plug 101 with the set retainer 300, the well bore 2, or other piece of equipment.

The apparatus 100 may be designed to interact with the well bore 2 and other equipment when used. The well bore 2 into which the wiper plug 101 is inserted may have a perforated casing 4 or otherwise provide for fluid communication to the fracture 6 in the formation 3, where proppant 7 has been underdisplaced. The wipers 103 may remove proppant 7 from the well bore 2 as the wiper plug 101 travels downhole, and the wiper plug 101 can eventually reach the set retainer 300 designed to interface with the wiper plug 101. The set retainer 300 is described in further detail below. The set retainer 300 can stop or obstruct the wiper plug 101 and any removed proppant 7 may be pushed downhole by the wiper plug 101. In some embodiments, the set retainer 300 is located uphole of the fracture 6.

Figure 4A:
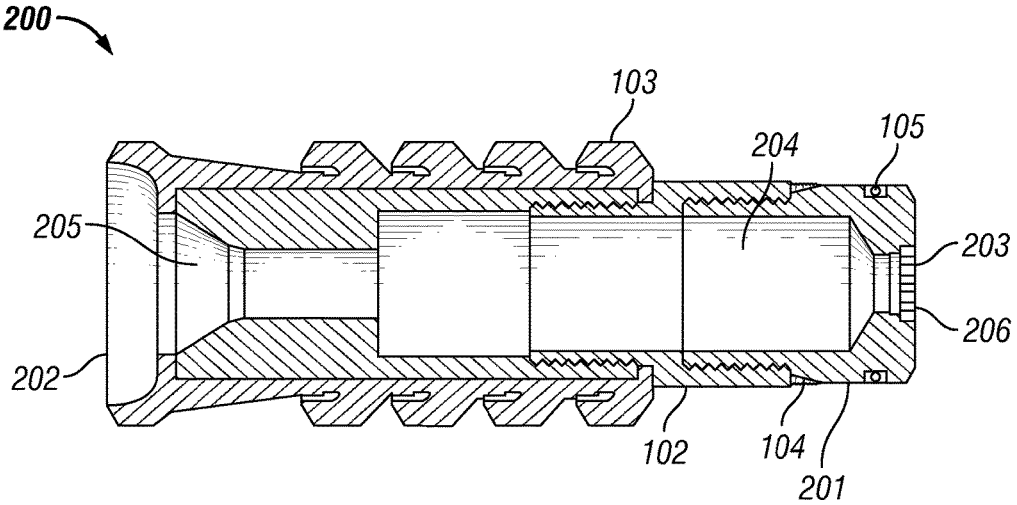
FIG. 4A depicts a wiper plug apparatus for use both vertical and deviated (e.g. horizontal) well bores.

A second apparatus 200, depicted in FIG. 4A, may be used to clean underdisplaced proppant 7 in a horizontal section 21 of a well bore 2. The apparatus 200 is a substantially cylindrical wiper plug 201 with a body 102 and wipers 103 disposed on the body 102, and oriented to have a first end 202 and a second end 203. Unlike the previously described wiper plug 101, the present wiper plug 201 can include a hollow passage 204 which extends from the first end 202 to the second end 203 of the wiper plug 201. The first end 202 of the passage 204 can further include a landing seat 205 designed to receive a stopper 502 (shown in FIGS. 7A-7E). This purpose can also be achieved by slips, pins, seals, or similar mechanical bonding mechanisms (not shown) which would be capable of retaining the stopper 502. When the stopper 502 is retained on the passage 204, proppant 7 and fluids are obstructed or potentially incapable of flowing from the first end 202 to the second end 203 of the wiper plug 201. A rupture disc 206 may be retained inside the passage 204, optionally closer to the second end 203 of the wiper plug 201.

The rupture disc 206 may be configured to block fluid flow through the passage 204 but rupture mechanically or at a desired pressure via selection of a particular material. When the rupture disc 206 ruptures, any fluid used to pump the wiper plug 201 into the well bore 2 is permitted to flow further into the well bore 2 by flowing through the passage 204 of the wiper plug 201. Afterwards, the wiper plug 201 can be closed again by retaining a flow preventer (e.g., stopper 502) within the passage 204. The stopper 502 can be lodged near the first end 202 of the passage 204, and may not be designed to rupture under any expected conditions. Similar to the previous wiper plug 101, retaining slips 104 can be present on the body 102 of the wiper plug 201, in order to be retained and latched to the set retainer 300 placed elsewhere inside the well bore 2. One or more seals 105 can also be located on the wiper plug 201 as another way to connect the wiper plug 201 to the set retainer 300, the well bore 2, or other piece of equipment. In some hydraulic fracturing designs, such seating by the wiper plug 201 may not be possible (For Example due to erosion of the seals 105 by abrasive fluid used) or as a choice to for example create a more robust pressure holding point (2 barriers). However, the design described here solves the problem by placing an industry pump down hole plug uphole to provide the fracture divergence pressure required for the next stimulation stage.

Figure 4B:
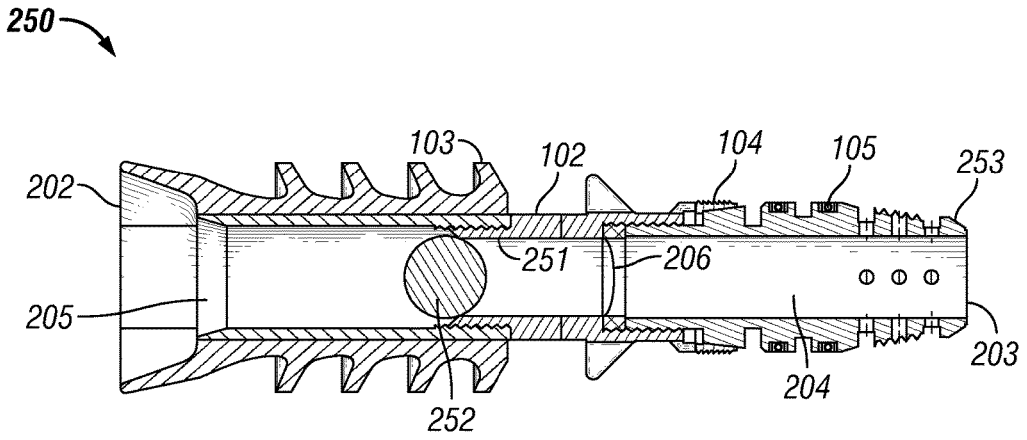
FIG. 4B depicts an alternative design for a wiper plug apparatus for use in both vertical and deviated well bores.

Yet another alternative wiper plug apparatus is depicted in FIG. 4B, and this alternative design is also capable of being used in a deviated well bore. Wiper plug 250 can have a design similar to wiper plug 201, with body 102, including a first end 202 and a second end 203, on which a plurality of wipers 103 can be mounted. A passage 204 can also connect first end 202 to second end 203, with optional rupture disc 206 therein. This apparatus can differ from the previously-described wiper plugs in that passage 204 can include a ball seat 251 dimensioned to catch a ball 252, stopper 502, or other flow preventing apparatus. Some exemplary balls 252 include fracture balls, bearing balls, ceramic spheres, and equivalent units known in the art. Ball 252 is capable of obstructing the flow of materials through passage 204 after rupture disc 206 has ruptured.

In another version, the ball seat 251 and the rupture disc 206 may be avoided altogether, eliminating pressure divergence functionality of the the wiper seat. In such an embodiment, the ball seat 251 may be replaced by a one-way check valve (e.g., injection into the reservoir direction) and the sealing functionality may be added by placing an industry pump downhole plug uphole to provide the fracture divergence pressure required for the next stimulation stage.

Wiper plug 250 or wiper plug 201 can also be designed with other features. Centralizers 254 may be located on the outside of body 102 and are capable of assisting wiper plug 250 in engaging set retainer 300, the well bore 2, or another piece of well bore equipment. The additionally featured retaining slips 104, seals 105, and nose 253 can also aid the wiper plug 250 in being stopped by the set retainer 300, the well bore 2, or another piece of well bore equipment.

Figure 5:
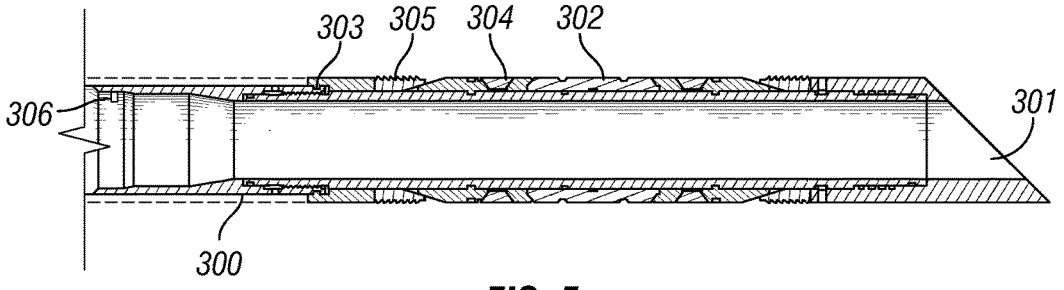
FIG. 5 depicts a set retainer operable for use in both deviated and vertical well bores.

A set retainer apparatus, shown in FIG. 5, is relevant to the wiper plugs 101, 201, and 250 and the methods below. The set retainer 300 may be installed within the well bore 2 and can be uphole of any well bore perforations 5 to be used for a hydraulic fracture formation site. The set retainer 300 may be substantially annular in shape, with an outer diameter that is less than that of the well bore. This choice of sizing permits the set retainer 300 to travel through the well bore 2 unimpeded until reaching a desired destination. The set retainer 300, having an annular shape, may also contain a passage 301 through which materials such as proppant 7 can pass. The passage 301 may also be configured to receive a wiper plug.

At least one packer 302 can be located on the outside of the set retainer 300, but preferably two or more are used. The packer 302 includes a compressible material such as rubber, which may be uncompressed upon entry and therefore allows the diameter of the set retainer 300 to pass to the desired location. After the set retainer 300 reaches its destination, however, a shear pin 303 can be forcibly sheared, thereby causing an expansion ring 304 on set retainer 300 to lift, and thereby forcing the packer 302 into a compressed state. When this happens, deformation of the packer 302 may cause it to extend outwardly towards the wall of the well bore 2 and contact it. The friction between the packer 302 (or several packers) and the well bore 2 may help to hold the set retainer 300 in position and seal off flow around the set retainer 300.

To further aid the installation of the set retainer 300, the shearing of shear pin 303 can also cause a retaining slips 305 to be pushed into the side of the well bore by the set retainer 300 at the same time that the expansion ring 304 causes the packer 302 to deform. The retaining slips 305 may bite into the wall of the well bore 2 and increase static friction between the set retainer 300 and the well bore 2. The interior of the set retainer 300 can include a latch 306 designed to receive a wiper plug as described above. This latch 306 may hold the wiper plug within the set retainer 300 at its desired location inside the well bore 2.

In consideration of the equipment described above, embodiments of two methods for using these components to wipe underdisplaced proppant from the well bore will now be discussed.

Figure 6A:
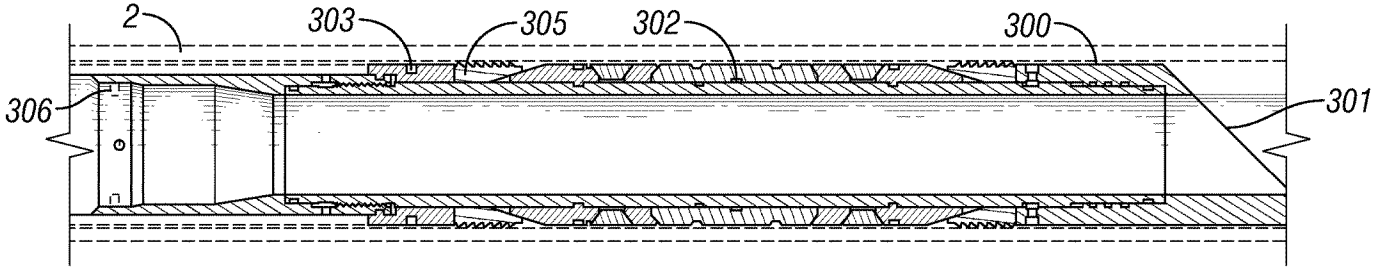
FIGS. 6A-6C represent a method capable of being used in a vertical well bore.
Figure 6B:
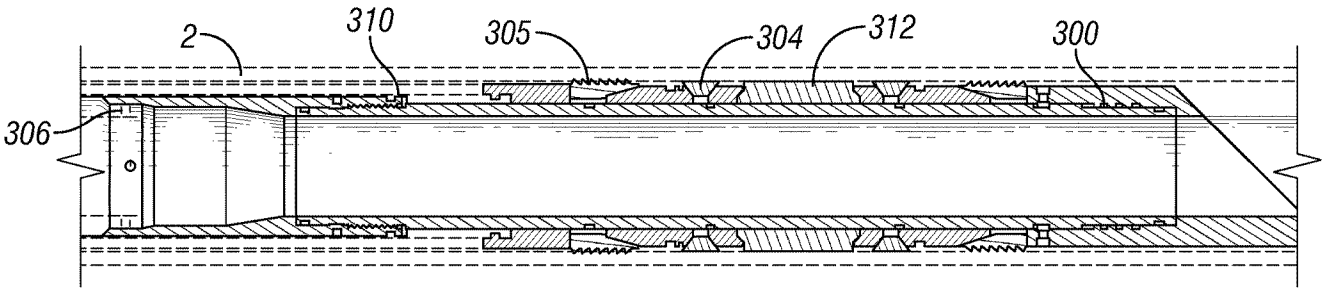
Figure 6C:
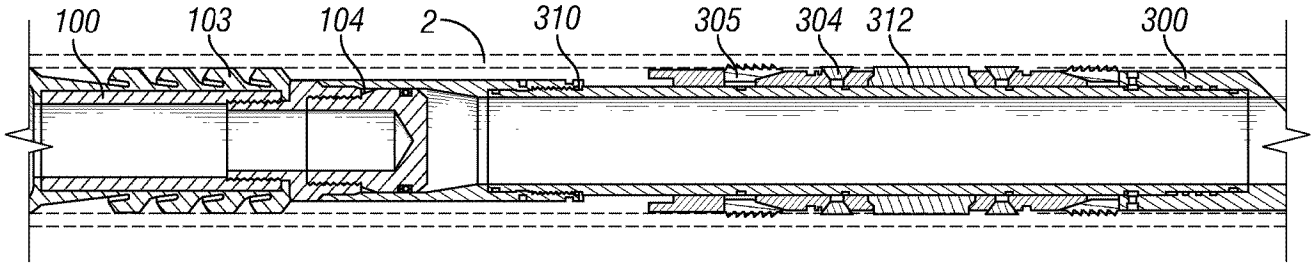

A general, basic method for displacing fracture proppant 7 in a well bore 2 to improve its concentration in the critical zone 8 is depicted in FIGS. 6A-6C. The method depicted in these figures is suitable for a vertical well bore, even though the figures depict a horizontal alignment. This method can also be adapted for any other deviated well bore.

The first step of the method is to install a set retainer 300 within the well bore 2 by running the set retainer 300 to a desired location in the well bore 2. The desired location should be uphole of any well bore perforations 5 that have not yet been used to create a fracture 6. As the set retainer 300 runs through the well bore 2, the packer 302 is uncompressed and the retaining slips 305 remain in place because the shear pin 303 has not been sheared. The set retainer 300 can be run into the desired location by the force of gravity, with the aid of an injection fluid (not shown), or some combination of techniques. If injection fluid is used, the fluid can be a wide variety of fluids such as slick water, diesel, an oil-based fluid, gelled or ungelled, propane, or gelled propane, linear or guar-based gel, hydroxyethyl cellulose (HEC), or foam. The set retainer 300 may also be preferably tethered to the surface by a wireline (not shown) or equivalent connection apparatus. A setting tool (not shown) such as a baker setting tool may be used to run the set retainer 300 through the well bore 2.

The set retainer 300, as described previously, may include a passage 301 and a latch 306 designed to be attached to a wiper plug, such as the previously described wiper plugs 101, 201, or 250. Once the set retainer 300 is in position, the setting tool (not shown) or other placement equipment may cause the shear pin 303 to shear. The sheared section 310 may cause the packer 302 (FIG. 6A) to compress and thereby become a compressed packer 312 (FIG. 6B). The retaining slips 305 may also be moved to a position where they engage the well bore 2. This configuration of the set retainer 300 is shown in FIG. 6B. The set retainer 300 thus can be installed within the well bore 2 and made ready to receive a wiper plug 101, 201, 250.

Next, a proppant-laden fluid (not shown) may be injected into the well bore 2, and can be the same fluid or type of fluid that could have been used to create the fracture 6. The proppant 7 used in this fluid can include a variety of materials such as sand, mortar, walnut shells, glass beads, metal pellets, ceramic beads, or a combination of these items. The fluid may enter perforations 5 by flowing through the passage 301 of the set retainer 300. The fluid, if it contains compounds used for fracturing, may create the subsurface fracture 6 by flowing through the perforations 5 or otherwise engaging the formation 3. Proppant 7 can flow into the newly-created fractures 6, but some of it may remain inside the well bore 2 as a leftover proppant. A wiper plug 101, 201, 250 may then be inserted into the well bore 2, and its passage can be aided by using further injection fluid (not shown). This injection fluid can be the same fluid, the same type of fluid, or different a different fluid from any injection fluid that could have been used to previously install the set retainer or create the fracture 6.

The wipers 103 of the wiper plug 101 may wipe or push a portion of the proppant-laden fluid or leftover proppant further into the well bore 2 and ultimately past or downhole of the set retainer 300 and into the fracture 6. While some of the proppant-laden fluid is displaced completely into the fracture, some proppant-laden fluid will be left on either side of the fracture/well bore interface. Preferably, in the critical zone 8 of the fracture 6, significant amounts of proppant 7 will then be present. Since proppant 7 is swept downhole by the wiper plug 101, 201, 250, the proppant 7 may be able to flow into the newly created fracture 6 and therefore improve conductivity by entering the critical zone 8, instead of remaining inside the well bore 2 where the proppant 7 could potentially obstruct other installations or pieces of equipment. Referring to FIG. 6C, the wiper plug 101, 201, 250 can be received by the set retainer 300 by contacting or engaging its side or retaining slips 104 with at least one latch 306 located inside the passage 301 of the set retainer 300. The wiper plug 101,201,250 may then provide a seal against the passage 301 of the set retainer 300. The latch 306 alternatively can be omitted if the set retainer 300 is dimensioned to hold the wiper plug 101, 201, 250 in place by the force of gravity. The process can thereafter be repeated by perforating more sections of the well bore, casing, or pipe above the wiper plug 101 and repeating the process as many times as desired.

After the process is completed, it can be desirable to conduct further operations inside the well bore 2. To remove the installed wiper plugs and set retainers, the equipment can be forcibly removed by a method such as drilling, chemical disintegration, or the injection of pressurized fluids. If some pieces of equipment, such as the set retainer 300, are to be preserved for future operations, they can be run on a wireline or may be retrieved, by using a downhole retrieving tool, and pulled out of the well bore 2 after the process steps are completed.

A second alternative method is suitable for deviated well bore sections, and achieves the same results of wiping underdisplaced proppant from the well bore and increasing proppant concentration at the critical zone to enhance near-well bore conductivity.

The significant differences between this second method, for deviated well bore, and the first method are demonstrated by further steps shown in FIGS. 7A-7E. Each of these figures depicts an embodiment of the method at five different stages.

Figure 7A:
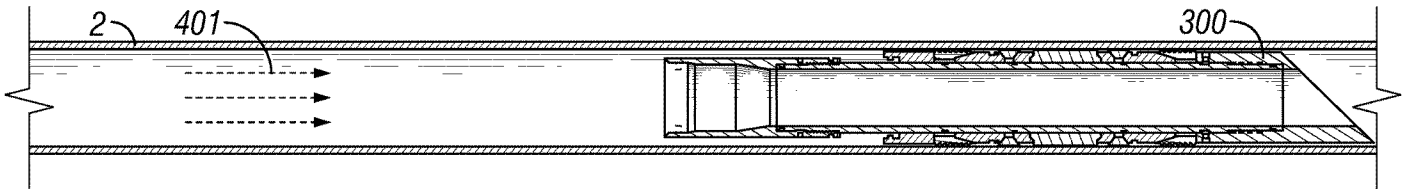
FIGS. 7A-7E represent a method capable of being used in both vertical and deviated well bores.

This method can be initially similar to the previous method. A set retainer 300 is installed within the well bore 2 by running it to a desired location. The set retainer 300 may be installed uphole of a well bore perforation 5 that has not yet been used to create a subsurface fracture 6. Before installation, a shear pin 303 can be disposed on the set retainer 300 and may be unsheared, so that the packer 302 remains uncompressed. Additionally or alternatively, a retaining slips 305 may not be in contact with the well bore 2 as the set retainer 300 is run in. FIG. 7A depicts this state in an embodiment of the method. If the method is used in a deviated section, a first injection fluid 400 may be used alone or in combination with other techniques to install the set retainer 300 at a desired position. An appropriate injection fluid can include slick water, diesel, an oil-based fluid, propane, linear or guar-based gel, hydroxyethyl cellulose (HEC), or foam. For future ease of removal, the set retainer 300 may be tethered to the surface by a wireline (not shown) or an equivalent surface connector. A a setting tool (not shown), such as a baker setting tool, can be used to run the set retainer 300 into the well bore 2 to be installed at the desired position. Thus, the set retainer 300 may be pumped, along with the first injection fluid 400 into the well bore 2.

Figure 7B:
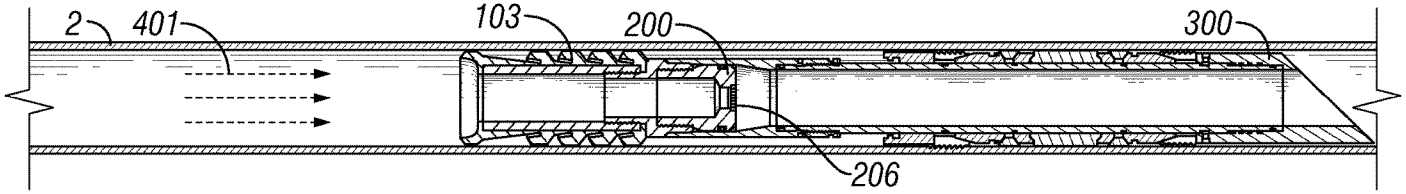

The set retainer 300 depicted in FIG. 7B is shown as having engaged the side of the well bore 2 and has been installed. As discussed previously, this can be accomplished by one or more packers, retainer slips, or other equipment designed to actuate upon the shearing of a shear pin. If a shear pin 303 is disposed on the set retainer 300, a setting tool can shear the shear pin 303 after running in the set retainer 300. The first injection fluid 400 used to install the set retainer 300 is preferably operable to create a hydraulic fracture and more preferably laden with proppant. The proppant used in this fluid can include a variety of materials such as sand, mortar, walnut shells, glass beads, metal pellets, ceramic beads, or a combination of these items. However, a separate fluid or fluids can be used to create the fracture and provide proppant to the newly created fracture. It is desired for some or all of the proppant enter the fracture and remain in the critical zone, but in many cases there will still be some amount of proppant left inside the well bore 2. Potential difficulties caused by latent proppant may be reduced or avoided by an embodiment of the disclosed method.

At this point, the set retainer 300 may be ready to receive a wiper plug 201, 250. The wiper plug in this method is an embodiment of the apparatus depicted in FIGS. 4A and 4B, which was described in detail previously. The wiper plug 201, 250 is pumped into the well bore 2 by a second injection fluid 401, which can be the same injection fluid used for the set retainer 300 or a different fluid. The second injection fluid 401 may be used to pump the wiper plug 201, 250 and may not contain additional proppant, though the fluid may include proppant if desired. As the wiper plug 201, 250 travels through the well bore 2, some of the proppant 7 remaining inside the well bore 2 from the first injection fluid 400 or a previous injection may be wiped downhole by the wiper plug 201, 250, through the set retainer 300. If the wiped proppant enters the fracture, the amount of proppant 7 in the fracture's critical zone 8 may increase and potentially enhance the near-well bore conductivity of the fracture 6. The wiper plug 201, 250 may then be received by the set retainer 300 by colliding with it or engaging with components on the set retainer 300. For example, the set retainer 300 can have a latch or seal designed to engage a retainer slip disposed on the wiper plug 201, 250. FIG. 7B depicts of the wiper plug 201, 250 being retained by the set retainer 300 in one embodiment.

If further fracturing operations are desired, a perforation assembly 500 may next be inserted into the well bore with the aid of a third injection fluid. This third injection fluid can be similar to or different from the first injection fluid and the second injection fluid. The perforation assembly can be composed of a perforation gun 501 and a stopper 502 mechanically coupled to each other. A connector rod 503 and centralizer 504 can be used for mechanical coupling. The connector rod 503 and centralizer 504 can help balance the load of the perforation assembly 500 if they are used, but other forms of mechanical coupling between the perforation gun 501 and stopper 502 are contemplated. The perforation assembly 500 may be run on a wireline (not shown) or tethered to a point at or near the surface of the earth, such that the equipment can be recovered by pulling reusable components to the surface after the method steps are completed.

Figure 7C:
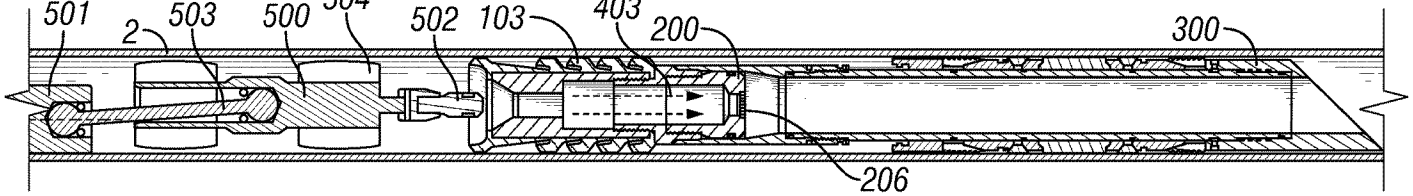

A rupture disc 206 can be composed of material configured to rupture at a pressure defined by the method's user, and can also be disposed on the wiper plug 201, 250. The rupture disc 206, if used, can rupture after being subjected to pressure from the second injection fluid 401 and third injection fluid. This may remove some or all of the second injection fluid 401 and third injection fluid from the well bore. FIG. 7C depicts an embodiment of the method before a rupture disc 206 has ruptured, with the combined second and third injection fluids 403 subjecting the rupture disc 206 to pressure.

Figure 7D:
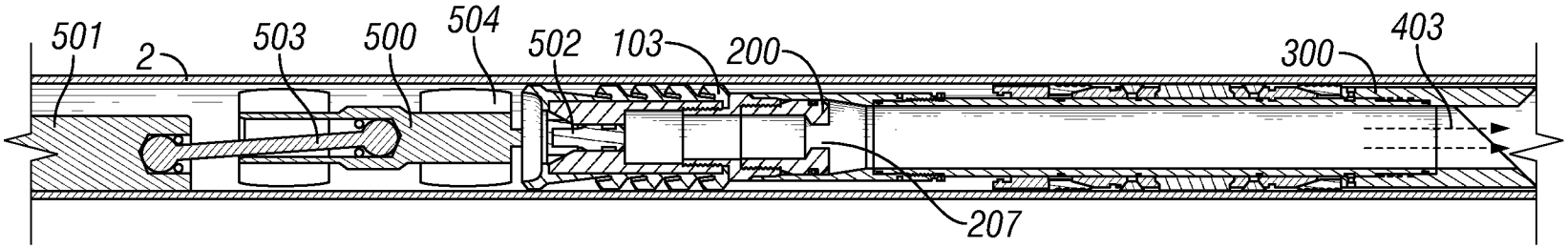

When the rupture disc is in a ruptured state 207, the combined second and third injection fluids 403 may enter the downhole portions of well bore 2 via a newly formed passage through both the wiper plug 201, 250 and set retainer 300. The combined injection fluid or fluids can be flushed outside the well bore 2 by flowing through the perforations 5 and into the fracture 6, or can travel to downhole sections of the well bore 2. A stage of the method following the rupture of the rupture disc is depicted in FIG. 7D.

To close off the downhole portions of well bore 2, the perforation assembly 500 can be allowed to contact the wiper plug 201, 250. The stopper 502 of the perforation assembly 500 may be receivable by the wiper plug 201, 250, and a receiving action can be aided by a landing seat 205 of the passage inside the wiper plug 201, 250. Preferable methods for receiving the stopper 502 on the wiper plug 201, 250 include slip retainers, latches, adhesive material, and other appropriate mechanisms to mechanically connect two or more components. FIG. 7D depicts a stopper 502 in the form of a seal plug being inserted into the wiper plug 201.

Figure 7E:
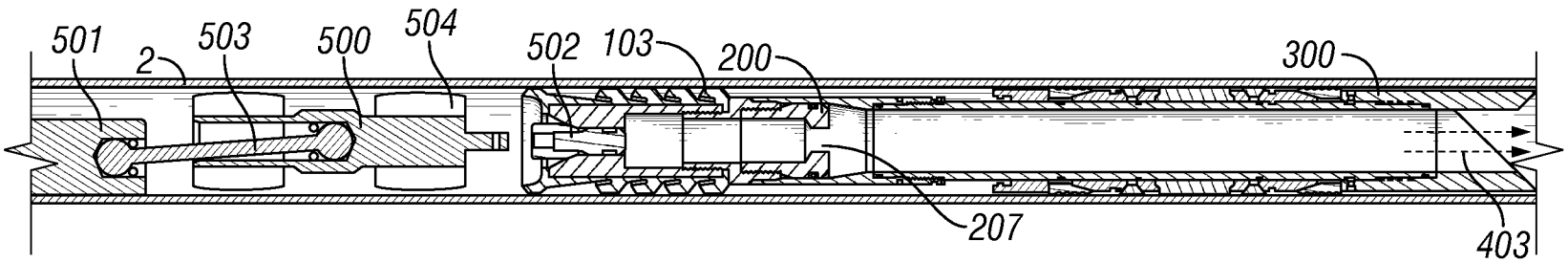

A user can take further optional steps to enhance this method's economic effectiveness. Following the receipt of the stopper 502 by the wiper plug 201, the perforation assembly 500 can detach the stopper 502 from the perforation gun 501. This detachment step is possible, if desired, by using a shear pin (not shown) to connect the centralizer 504 to the stopper 502. The shear pin, when sheared, would cause the centralizer 504 of the perforation assembly 500 to detach itself from the stopper 502. FIG. 7E depicts an embodiment of the method using this optional step, after a shear pin has been sheared.

Afterwards, the perforation gun 501 is capable of being moved by the user to a desired location. The user can move the perforation gun 501 to a site where further perforations and hydraulic fractures are desired, remove it from the well bore 2, or move it to a different location for other purposes. If the perforation gun 501 is aligned with a desired fracturing site, it can perforate another part of the well bore 2 to prepare the well bore for an additional hydraulic fracture. The perforation assembly 500 can then be removed from the well bore 2, along with any other reusable equipment such as the set retainer 300. Alternatively, the components used in this method, such as the wiper plug 201, 250, and the stopper 502, can be forcibly removed by methods such as drilling, injection of pressurized fluids, or chemical disintegration.

If the well bore 2 is particularly lengthy, the steps of this method can be repeated cyclically to extract hydrocarbons or other energy resources from a formation beneath the surface of the earth. A cost-effective manner of cycling the process would be to first apply the method in downhole sections of a well bore, and then repeat its steps in successive sections uphole of the first site.

In FIGS. 8A through 8D depict an alternative arrangement of steps for installing a wiper plug 201, 250 within a deviated well bore. Those having ordinary skill in the art will recognize that these steps can be performed either alone or in combination as convenient.

Figure 8A:
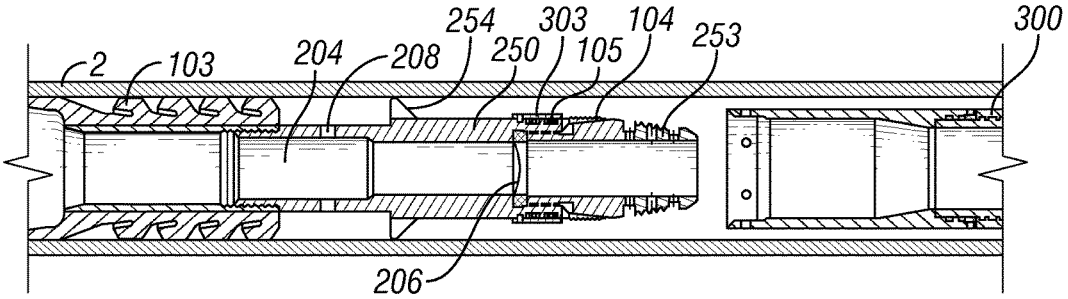
FIGS. 8A-8D represent an alternative method capable of being used in both vertical and deviated well bores.

In FIG. 8A, the wiper plug 250 can be configured for receipt by set retainer 300 when being pumped or otherwise inserted into well bore 2. The wiper plug 201, 250 can feature a shear pin 303 configured to contact narrow section of set retainer 300, and thereby allow shear pin 303 to be sheared. Shear pin 303 can also prevent seals 105 from contacting well bore 2 or other obstructions, which may be present between wiper plug 201, 250 and set retainer 300. In addition, wiper plug 201, 250 can include a nose 253 capable of contacting the narrow section of set retainer 300 to further allow wiper plug 201, 250 to be retained by set retainer 300. Similarly, centralizers can be present on wiper plug 201, 250 and further can be dimensioned such that set retainer 300 obstructs the centralizers from traveling further in well bore 2 upon contacting set retainer 300. The wiper plug 201, 250 can include wipers 103 capable of wiping proppant 7 from the side of well bore 2 as the wiper plug 201, 250 moves further into the well bore 2. If desired, the rupture disc 206 may be present on wiper plug 201, 250.

Figure 8B:
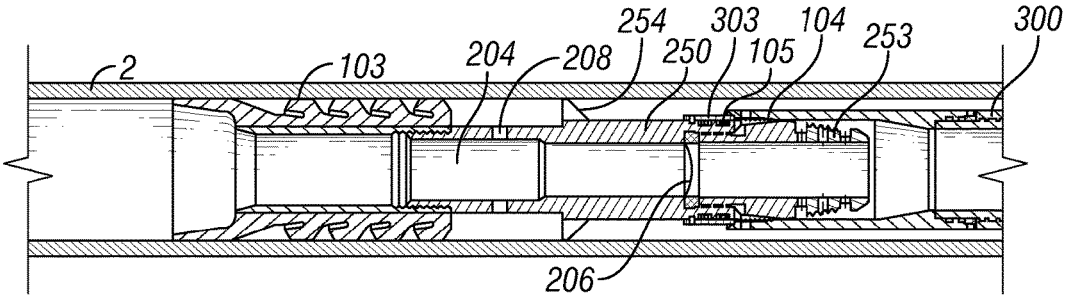

FIG. 8B shows wiper plug 201, 250 meeting set retainer 300, where shear pin 303, if present, can contact the edge of set retainer 300. When such contact occurs, the mass of set retainer 300 can actuate a force on shear pin 303 and cause shear pin 303 to shear and uncover seals 105.

Figure 8C:
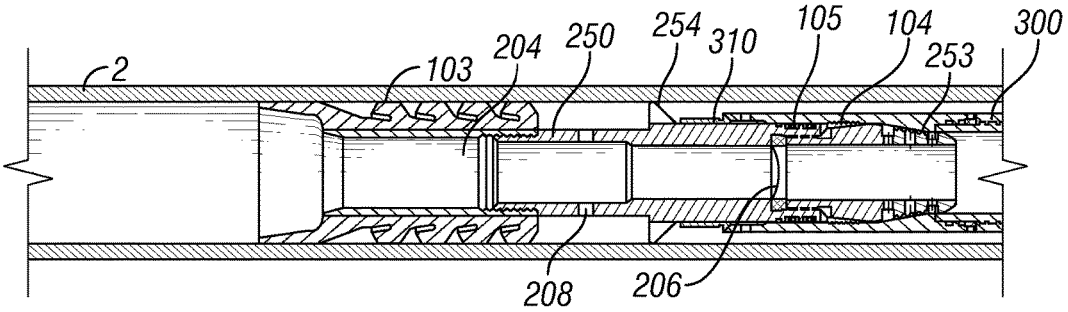

FIG. 8C depicts wiper plug 201, 250 in the case where a shear pin 303 has been sheared by set retainer 300 and is now shown as sheared section 310. Here, the uncovered seals 105 (if present) can now contact and adhere to the inside of set retainer 300. The ability to seat wiper plug 201, 250 on set retainer 300 can be aided by retaining slips 104 and nose 253. If centralizers are provided on wiper plug 250, they can serve to further restrict wiper plug 250 from moving after being seated on set retainer 300. If bypass ports 208 are provided on wiper plug 250, centralizers can also prevent fluids, such as pumping fluids, from moving past wiper plug 250 and further into well bore 2. The bypass ports 208 may be disposed on the body 102 and configured to permit fluid communication between the passage 204 and an annulus between the well bore 2 and the wiper plug 250. If a rupture disc 206 is present, and is ruptured by pressure from a fluid, such as an injection fluid, wiper plug 250 can be made ready to receive a stopper.

Figure 8D:
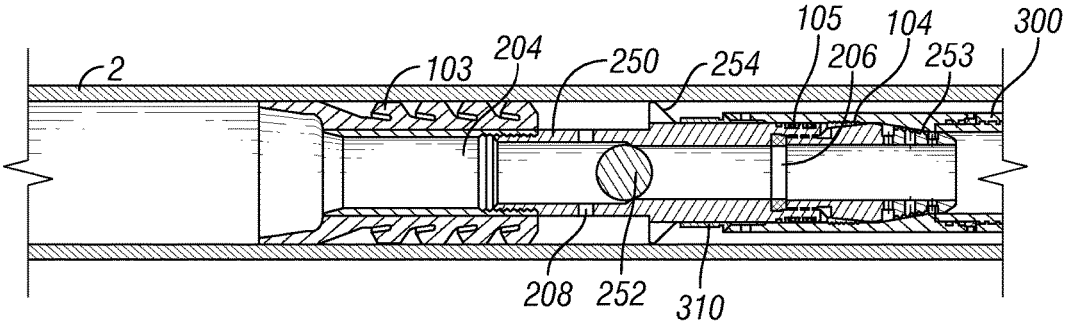

In FIG. 8D, a further method step for using a ball 252 is provided. If it is desired to obstruct passage 204 after rupture disc 206 is allowed to rupture, ball 252 is pumped into well bore 2 with an injection fluid. Ball 252 may come to rest in passage 204 of wiper plug 201 at an appropriately dimensioned point or narrowed section or other ball seat 251. Ball 252 can offer a further advantage in that no equipment may be necessary to remove ball 252 after it is pumped into well bore 2. Ball 252 simply remains within wiper plug 250 and further fracturing operations can continue uphole. In these further operations, other wiper plugs may be installed and later closed by the same method or other methods.

In an alternate embodiment, the set retainer 300 may be run into the well bore 2 coupled to the perforation gun 501. For example, the set retainer 300 and the perforation gun 501 may be run on a wireline (not shown). The perforation gun 501 may be uphole of the set retainer 300 when the set retainer 300 is set (e.g., via setting tool, pressurization, or other method of setting the set retainer 300). The set retainer 300 may be detached or severed from the wireline and the perforation gun 501 either during or after the setting process. Then, once the set retainer 300 is set, the perforation gun 501 may be threaded or otherwise moved through the passage 301 of the set retainer 300 so that the perforation gun 501 is downhole of the set retainer 300. In order to allow the perforation gun 501 to pass through the set retainer 300, it may be desirable for either the set retainer 300 or the perforation gun 501 or both to have profiles to assist in such passage.

At that point, the perforation gun 501 may be used to provide the perforations 5. Then the perforation gun 501 may be pulled back through the set retainer 300 via the wireline and either removed from the well bore 2 or optionally used to provide additional perforations. Once the perforations 5 have been made, proppant 7 can be introduced while initiating fractures 6 from the perforations 5 such that proppant 7 enters the fractures 6. Subsequently, one of the wiper plugs 101, 201, 250 may be run into the well bore 2, followed by a spacer fluid. Once the wiper plug 101, 201, 250 lands in the set retainer 250, previously underdisplaced proppant becomes properly displaced. If present, the rupture disc 207 may then be ruptured to allow a blocker or other fluid to be introduced to isolate the fractures 6 and/or passage of fluid therethrough so that the perforation gun 501 may be run into the well bore 2 once again. Once the perforation gun 501 and optionally another set retainer 300 are run to the area uphole and adjacent to the location of the first set retainer 300, the ball 252 may be dropped and may land in the ball seat 251 of the wiper plug 250. Alternatively, the ball 252 may be pumped immediately before the perforation gun 251. Alternatively, if a ball seat 251 is not present in the particular wiper plug 101, 201, 250, the stopper 502 may be run along with the perforation gun 501 and optionally other elements of the perforation assembly 500. In any event, perforations are created uphole of the first set retainer 300 and the process can be repeated as many times as desired.

Although the preferred embodiments of the present apparatus and method have been described herein, the above description is merely illustrative. Further modification of the methods and apparatuses herein disclosed will occur to those skilled in the respective arts and all such modifications are deemed to be within the scope of the appended claims.

What is claimed is:

1. A method for creating a fracture in a well bore, the method comprising:
   a) providing a set retainer having a passage configured to receive a wiper plug;
   b) installing the set retainer in the well bore;
   c) injecting a proppant-laden fluid into the well bore, through the passage of the set retainer and through a perforation to create the fracture;
   d) providing a wiper plug configured to be received in the passage of the set retainer;
   e) inserting the wiper plug into the well bore;
   f) allowing the wiper plug to wipe a portion of the proppant-laden fluid past the set retainer and into the fracture; and
   g) allowing the set retainer to receive the wiper plug.

2. The method of claim 1, wherein the proppant-laden fluid comprises a proppant selected from the group consisting of sand, mortar, walnut shells, glass beads, metal pellets, and ceramic beads, and combinations thereof.

3. The method of claim 1, wherein the set retainer comprises a latch and the wiper plug comprises a retainer slip, and wherein the method further comprises the step of allowing the latch to engage the retainer slip.

4. The method of claim 1, further comprising the step of forcibly removing at least one of the set retainer and the wiper plug from the well bore.

5. The method of claim 1, wherein the installing step comprises running the set retainer on a wireline, the method further comprising the step of pulling the wireline to remove the set retainer from the well bore.

6. The method of claim 1, wherein the set retainer comprises a packer, and wherein the step of installing comprises contacting the packer with the well bore.

7. The method of claim 1, wherein the proppant-laden fluid comprises an injection fluid selected from the group consisting of slick water, linear or guar-based gel, hydroxyethyl cellulose (HEC), diesel, an oil-based fluid, propane, and foam.

8. The method of claim 1,
   wherein installing the set retainer in the well bore comprises pumping the set retainer with a first injection fluid into the well bore;
   wherein inserting the wiper plug into the well bore comprises pumping the wiper plug with a second injection fluid into the well bore; and
   wherein the wiper plug comprises a rupture disc configured to rupture at a user-defined pressure;
   the method further comprising:
   h) providing a perforation assembly comprising a perforation gun coupled to a stopper;
   i) inserting the perforation assembly into the well bore and pumping a third injection fluid into the well bore, wherein the pumped third injection fluid ruptures the rupture disc to thereby form a passage through the wiper plug; and,
   j) allowing the passage to receive the stopper.

9. The method of claim 8, further comprising the steps of:
   k) detaching the stopper from the perforation gun;
   l) aligning the perforation gun with a desired perforation site; and, m) perforating the desired perforation site with the perforation gun.

10. The method of claim 9, further comprising the steps of:

n) removing the perforation gun after perforating the desired perforation site; and o) repeating steps a) through j) after steps k) through m) are completed.

11. The method of claim 9, wherein the stopper is attached to the perforation gun by a shear pin, and wherein step k) comprises shearing the pin.

12. The method of claim 8, wherein one of the perforation assembly and the set retainer is run on a wireline, the method further comprising the step of pulling the wireline to remove at least one of the perforation gun, the stopper, and the set retainer from the well bore.

13. The method of claim 8, wherein at least one of the first injection fluid, second injection fluid, and third injection fluid flows through the passage of the wiper plug and into the fracture.

14. The method of claim 1, further comprising:

h) prior to step b), providing a perforation gun coupled to the set retainer;

i) after step b), detaching the perforation gun from the set retainer; and j) after step i), creating the perforation with the perforation gun.

15. The method of claim 14, further comprising:

k) moving the perforation gun through the passage of the set retainer.

16. The method of claim 15, wherein step k) occurs after step i) and prior to step j).

17. An apparatus comprising:

a body with a passage extending from a first end to a second end and configured to retain a stopper;

a plurality of wipers disposed on the body;

a rupture disc configured to block fluid flow through the passage, and to rupture at a user-defined pressure; and, a slip retainer disposed on the body and configured to be retained by a set retainer having a latch.

18. The apparatus of claim 17, further comprising a bypass port disposed on the body and configured to permit fluid communication between the passage and an annulus between the well bore and the apparatus.

19. The apparatus of claim 17, further comprising a retaining nose disposed on the body.

* * * * *